United States Patent [19]

Silvestri, Jr.

[11] Patent Number: 4,888,954

[45] Date of Patent: Dec. 26, 1989

[54] METHOD FOR HEAT RATE IMPROVEMENT IN PARTIAL-ARC STEAM TURBINE

[75] Inventor: George J. Silvestri, Jr., Winter Park, Fla.

[73] Assignee: Westinghouse Electric Corp., Pittsburgh, Pa.

[21] Appl. No.: 330,407

[22] Filed: Mar. 30, 1989

[51] Int. Cl.[4] ..... F01K 13/02

[52] U.S. Cl. ..... 60/660; 60/652

[58] Field of Search ..... 60/646, 657, 652, 660

[56] References Cited

U.S. PATENT DOCUMENTS

| | | | |
|---|---|---|---|
| 4,096,699 | 6/1978 | Zitelli | 60/660 X |
| 4,178,762 | 12/1979 | Binstock et al. | 60/667 |
| 4,280,060 | 7/1981 | Kure-Jensen et al. | 60/646 |
| 4,297,848 | 11/1981 | Silvestri, Jr. et al. | 60/600 |
| 4,577,281 | 3/1986 | Bukowski et al. | 60/660 X |

OTHER PUBLICATIONS

G. W. Bouton et al.; "Ten Years Experience with Large Pulverized Coal-Fired Boilers for Utility Service"; Apr. 26–28, 1982; pp. 19–21.

L. G. Crispin et al.; "Jacksonville Electric Authority's Conversion of a Subcritical Once-Through Unit to Variable Pressure Cycling Duty"; Proceedings of the American Power Conference; pp. 1–7, (No Date).

*Primary Examiner*—Allen M. Ostrager

[57] ABSTRACT

Method for improving the heat rate of a steam turbine operated in a partial-arc mode includes sequential closing of control valves to establish a first arc of admission followed by a reduction of steam pressure to a predetermined level. Additional valves are closed to bring the admission arc to an optimum value and power reduction is thereafter affected by pressure reduction. In a further method, low power operation is achieved by reducing the arc of admission below optimum when steam pressure has been reduced to a minimum value.

5 Claims, 4 Drawing Sheets

METHOD FOR HEAT RATE IMPROVEMENT IN PARTIAL-ARC STEAM TURBINE

This invention relates to steam turbines and, more particularly, to a method and apparatus for improving the heat rate (efficiency) of a partial-arc admission steam turbine.

BACKGROUND OF THE INVENTION

The power output of many multi-stage steam turbine systems is controlled by throttling the main flow of steam from a steam generator in order to reduce the pressure of steam at the high pressure turbine inlet. Steam turbines which utilize this throttling method are often referred to as full arc turbines because all steam inlet nozzle chambers are active at all load conditions. Full arc turbines are usually designed to accept exact steam conditions at a rated load in order to maximize efficiency. By admitting steam through all of the inlet nozzles, the pressure ratio across the inlet stage, e.g., the first control stage, in a full arc turbine remains essentially constant irrespective of the steam inlet pressure. As a result, the mechanical efficiency of power generation across the control stage may be optimized. However, as power is decreased in a full arc turbine, there is an overall decline in efficiency, i.e., the ideal efficiency of the steam work cycle between the steam generator and the turbine output, because throttling reduces the energy available for performing work. Generally, the overall turbine efficiency, i.e., the actual efficiency is a product of the ideal and the mechanical efficiency of the turbine.

More efficient control of turbine output than is achievable by the throttling method has been realized by the technique of dividing steam which enters the turbine inlet into isolated and individually controllable arcs of admission. In this method, known as partial-arc admission, the number of active first stage nozzles is varied in response to load changes. Partial arc admission turbines have been favored over full arc turbines because a relatively high ideal efficiency is attainable by sequentially admitting steam through individual nozzle chambers with a minimum of throttling, rather than by throttling the entire arc of admission. The benefits of this higher ideal efficiency are generally more advantageous than the optimum mechanical efficiency achievable across the control stage of full arc turbine designs. Overall, multi-stage steam turbine systems which use partial-arc admission to vary power output operate with a higher actual efficiency than systems which throttle steam across a full arc of admission. However, partial-arc admission systems in the past have been known to have certain disadvantages which limit the efficiency of work output across the control stage. Some of these limitations are due to unavoidable mechanical constraints, such as, for example, an unavoidable amount of windage and turbulence which occurs as rotating blades pass nozzle blade groups which are not admitting steam.

Furthermore, in partial-arc admission systems the pressure drop (and therefore the pressure ratio) across the nozzle blade groups varies as steam is sequentially admitted through a greater number of valve chambers, the largest pressure drop occurring at the minimum valve point (fewest possible number of governor or control valves open) and the smallest pressure drop occurring at full admission. The thermodynamic efficiency, which is inversely proportional to the pressure differential across the control stage, is lowest at the minimum valve point and highest at full admission. Thus, the control stage efficiency for partial-arc turbines as well as full arc turbines decreases when power output drops below the rated load. However, given the variable pressure drops across the nozzles of a partial-arc turbine, it is believed that certain design features commonly found in partial-arc admission systems can be improved upon in order to increase the overall efficiency of a turbine. Because the control stage is an impulse stage wherein most of the pressure drop occurs across the stationary nozzles, a one percent improvement in nozzle efficiency will have four times the effect on control stage efficiency as a one percent improvement in the efficiency of the rotating blades. Turbine designs which provide even modest improvements in the performance of the control stage nozzles will significantly improve the actual efficiency of partial-arc turbines. At their rated loads, evan a 0.25 percent increase in the actual efficiency of a partial-arc turbine can result in very large energy savings.

Sliding or variable throttle pressure operation of partial-arc turbines also results in improved turbine efficiency and additionally reduces low cycle fatigue. The usual procedure is to initiate sliding pressure operation on a partial-arc admission turbine at flows below the value corresponding to the point where half the control valves are wide open and half are fully closed, i.e., 50% first stage admission on a turbine in which the maximum admission is practically 100%. If sliding pressure is initiated at a higher flow (larger value of first stage admission), there is a loss in performance. However, in a turbine having eight valves, sliding from 75% admission eliminates a considerable portion of the valve loop (valve throttling) on the sixth valve which would occur with constant throttle pressure operation. A similar situation occurs when sliding from 62.5% admission: a considerable portion of the valve loop of the fifth valve is eliminated. Elimination of such valve loops improves the turbine heat rate and its efficiency.

FIG. 1 illustrates the effect of sliding pressure control in a partial-arc steam turbine having eight control valves. The abscissa represents values of steam flow while the ordinate values are heat rate. Line 10 represents constant pressure with throttling control while line 12 represents sliding pressure on a full arc admission turbine. Line 14 represents constant pressure with sequential valve control (partial-arc admission) and dotted lines 16, 18, 20 and 22 represent the valve loops. The valve loops result from gradual throttling of each of a sequence of control or governor valves. Sliding pressure operation from 75% admission is indicated by line 24. Note that much of the valve loop 20 is eliminated by sliding pressure along line 24 but that heat rate (the reciprocal of efficiency) increases disproportionately below the 62.5% admission point. Line 26, showing sliding pressure from the 62.5% admission point, provides some improvement but does not affect valve loops 16, 8 and 20. Similarly, sliding from 50% admission, line 28, helps at the low end but does not affect valve loops 16–22. Each of these valve loops represent higher heat rates and reduced efficiency from the ideal curve represented by line 14.

FIGS. 2, 3 and 4 illustrate the operation of an exemplary steam turbine using one prior art control. FIG. 2 shows the locus of full valve points, line 30, with constant pressure operation at 2535 psia. The valve points are at 50%, 75%, 87.5% and 100% admission with the valve loops identified by the lines 32, 34 and 36. Sliding pressure is indicated by lines 38, 40 and 42. Starting at 100% admission, about 806 MW for the exemplary turbine system, load is initially reduced by keeping all eight control valves wide open and sliding throttle pressure by controlling the steam producing boiler. When the throttle pressure, line 38, reaches the intersection point with the valve loop 32, the throttle pressure is increased to 2535 psia while closing the eight control valve. The control valve would continue to close as load is further reduced while maintaining the 2535 psia throttle pressure until this valve is completely closed at which point the turbine is operating at 87.5% admission. To further reduce load, valve position is again held constant, seven valves fully open, and throttle pressure is again reduced until the throttle pressure corresponds to the intersection of the sliding pressure line 40 and the valve loop 34 for the seventh valve. To reduce load below this point, the pressure is increased to 2535 psia and the seventh valve is progressively closed (riding down the valve loop) until it is completely closed. The admission is now 75%. To reduce load still further, the pressure is again reduced with six valves wide open and two fully closed until the throttle pressure line 42 reaches the intersection with the valve loop 36 where the fifth and sixth valves move simultaneously with constant throttle pressure operation. Then the operation of raising throttle pressure and closing of the valves is repeated for any number of valves desired. The variation in throttle pressure is illustrated in FIG. 3. The sloped portions 44 of line 46 relates to the sliding pressure regime with constant valve position. The vertical portions 48 relate to the termination of sliding pressure with no valve throttling and the uppermost point relates to operation at full pressure with valve throttling. The horizontal portions 50 relate to the riding down of the valve loop while reducing load at constant pressure. FIG. 4 shows the improvement in heat rate as a function of load. The line 52 illustrates the difference between valve loop performance at constant pressure and the performance with variable pressure between valve points.

The performance improvements shown in FIGS. 2 and 4 are based on the assumption that the boiler feed pump discharge is reduced as the throttle pressure is reduced. If it is not reduced proportionally, the improvement is reduced since the energy required to maintain discharge pressure remains high. In the prior art system, a signal is sent to the feed pumpfeed pump drive system to reduce pressure. In reality, however, the feed pump is followed by a pressure regulator in order to eliminate the need for constant adjustment of pump speed and the occurrence of control instability and hunting because of small variations in inlet water pressure to the boiler, resulting from perturbations in flow demand. The regulator, then, does more or less throttling which changes pump discharge pressure and theefore the flow that the pump will deliver. The pump speed is held constant over a desired range of travel of the regulator valve. When the valve travel gets outside these limits, the pump speed is adjusted to move the valve to some desired mean position. As a consequence, the pump discharge pressure does not equal the minimum allowable value (throttle pressure plus system head losses) and so the performance improvement is not as large as shown by FIGS. 2 and 4. In addition, in order to achieve quicker load response, the regulator valve is usually operated with some pressure drop so that if there is a sudden increase in load demand, the valve can open quickly and increase flow. The response of the pump and its drive is slower than the response of the regulator valve.

While sliding throttle pressure operation improves part load performance of steam power plants, studies have demonstrated that the highest performance levels are achieved by partial-arc admission turbines which initially reduce load from the maximum value by successively closing governor or control valves (sequential valve operation) while holding throttle pressure constant. When half the control valves are wide open and half are closed (50% admission on the first stage), valve position is held constant and further load reductions are achieved by varying or sliding throttle pressure. This combined method of operation has been referred to as hybrid operation. Hybrid operation with the transition point at 50% admission is believed to be the most efficient operation. However, a partial-arc admission turbine is subjected to shock loading at part load as the rotating blades pass in and out of the active steam arc. As a result, the blades must be stronger, which affects the aspect ratio and consequently the efficiency. Blade material or blade root damping is desirable to reduce the vibration stresses associated with partial-arc admission. In addition, the kilowatt loading (bending forces) on the individual rotating blades increases as the arc of admission is decreased. Sliding pressure operation (hybrid operation, more particularly) reduces the shock loading on the turbine first stage because the optimum values of minimum admission are higher than with constant throttle pressure operation.

Obtaining a first stage blade material or design with the required damping and strength for partial-arc operation is more difficult at elevated steam pressures and temperatures, for example, 4500 psig and 1100° F., of today's turbines. This limitation forces such high pressure, high temperature turbines to be operated with full-arc admission first stages because suitable materials for partial-arc admission are not available. If a material cannot be found that will allow partial-arc admission at 50% admission, the minimum admission arc could be increased at 62.5% or 75% admission, for example, with some loss in performance. The performance level would still be better than a full-arc admission design operating with sliding throttle pressure. However, with minimum arcs of admission much above 75%, there is little benefit to hybrid operation. In other cases, older turbines of more conventional type, such as those operating at 1000° F. or 1500° F., have been stressed such that partial-arc operation is limited. For such turbines, it is desirable to provide a method for improving performance without exceeding minimum allowable stress conditions.

SUMMARY OF THE INVENTION

Among the several objects and advantages of the present invention may be noted the provision of a method for operation of a partial-arc steam turbine which overcomes many of the disadvantages noted above and the provision of a method with faster load response and heat rate benefits on turbine systems; and, the provision of a method for operating high pressure, high temperature turbines in a hybrid mode without detrimental effect on control stage blading. The method also provides a means of improving operation of older turbines in which partial-arc operation has been limited by repeated fatigue loading.

The method of the present invention is described in a system in which a combination of control valve closure, sliding pressure and valve throttling is utilized to achieve better efficiency. In one embodiment, the method is illustrated for use in a turbine system in which the control stage can only tolerate the combined stresses of partial-arc shock loading and pressure drop corresponding to a 75% arc of admission due to material and blade root fastening limitations. Initial turbine power reduction is achieved by sequentially closing control valves to reduce the arc of admission to 75% at full operating steam pressure. Further reduction is achieved by reducing steam pressure (sliding pressure operation) while maintaining 75% admission. At a predetermined steam pressure, for example, corresponding to about 50% flow at 75% admission, pressure is held constant while additional control valves are closed to bring the admission to another value, such as 50% admission. Still further reduction is achieved by again sliding pressure.

In another embodiment, better efficiency is achieved by using a different rate of sliding pressure at high load than is used at low load. In this embodiment, valve closing is first used to reduce power output by sequentially closing valves until a first admission arc is reached, e.g., 75% for the above mentioned turbine. The transition from 75% admission to 50% admission is then implemented by closing valves concurrently with reductions in steam throttle pressure. The rates of valve closing and pressure reduction are set so that the pressure drop across the control stage does not exceed the pressure drop at the design throttle pressure and the minimum allowable admission corresponding to maximum throttle pressure. Starting at 50% admission, only sliding pressure operation would be used to control power generation.

In still a further embodiment, when a turbine is operating at a first predetermined partial-arc of admission, which arc is established by the maximum allowable pressure drop across the control stage, power reduction is attained by sliding steam pressure. However, once steam pressure has been reduced to its lowest limit, additional valves are closed to reduce the arc of admission to an optimum value. Further valve closings can be used to reduce the admission arc to a value at which no further heat rate improvement occurs. Below such value, throttling is used to control turbine power.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 5:
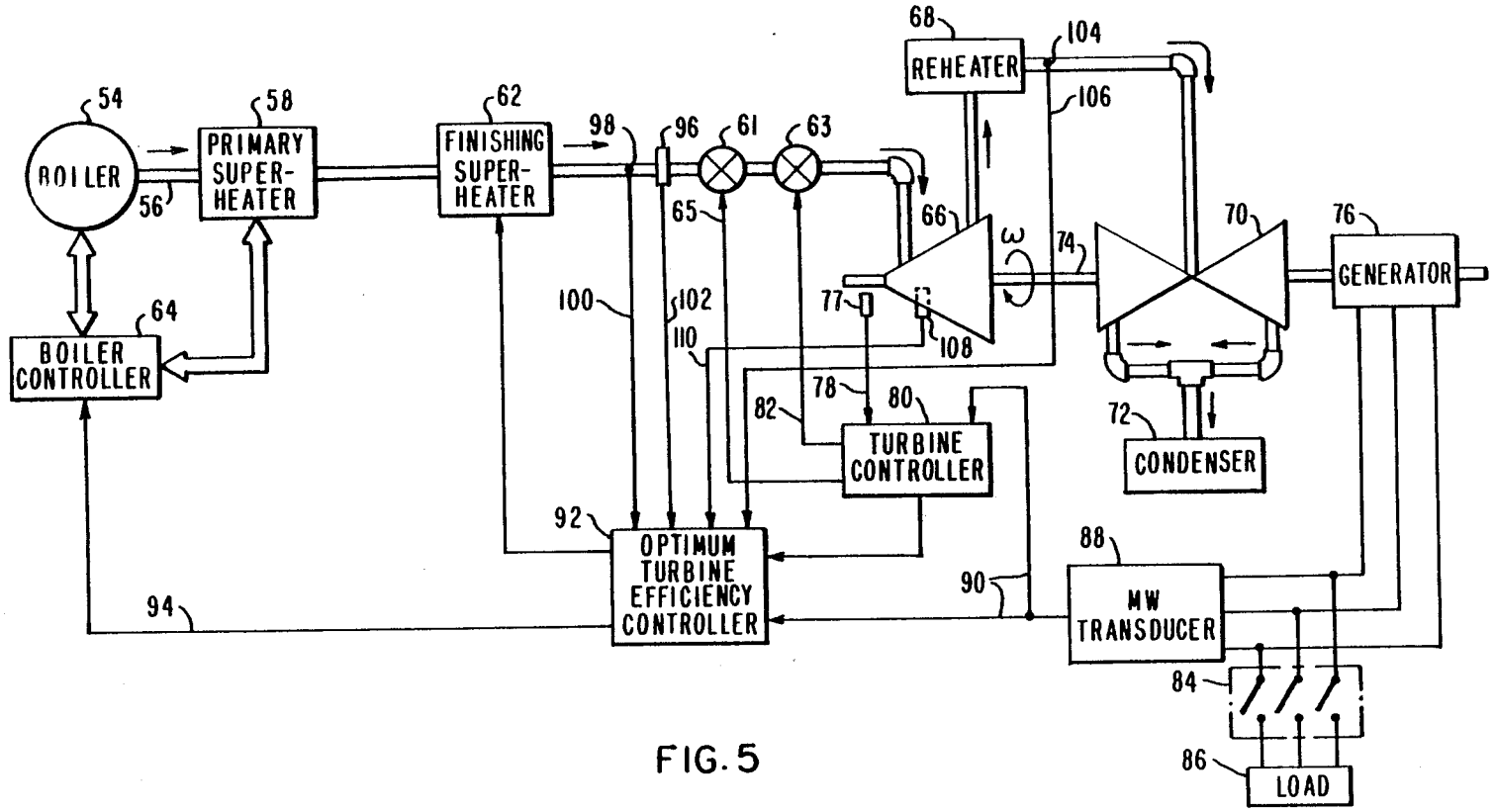
FIG. 5 is an illustration of one form of system for implementing the method of the present invention.

Before describing the method of the present invention, reference is first made to FIG. 5 which dipicts a functional block diagram schematic of a typical steam turbine power plant suitable for embodying the principles of the present invention. In the plant of FIG. 5, a conventional boiler 54 which may be of a nuclear fuel or fossil fuel variety produces steam which is conducted through a header 56, primary superheater 58, a finishing superheater 62 and throttle valve 61 to a set of partial-arc steam admission control valves depicted at 63. Associated with the boiler 54 is a conventional boiler controller 64 which is used to control various boiler parameters such as the steam pressure at the header 56. More specifically, the steam pressure at the header 56 is usually controlled by a set point controller (not shown) disposed within the boiler controller 64. Such a set point controller arragnement is well known to all those skilled in the pertinent art and therefore, requires no detailed description for the present embodiment. Steam is regulated through a high pressure section66 of the steam turbine in accordance with the positioning of the steam admission valves 63. Normally, steam exiting the high pressure turbine section 66 is reheated in a conventional reheater section 68 prior to being supplied to at least one lower pressure turbine section shown at 70. Steam exiting the turbine section 70 is conducted into a conventional condenser unit 72.

In most cases, a common shaft 74 mechanically couples the steam turbine sections 66 and 70 to an electrical generator unit 76. As steam expands through the turbine sections 66 and 70, it imparts most of its energy into torque for rotating the shaft 74. During plant startup, the steam conducted through the turbine sections 66 and 70 is regulated to bring the rotating speed of the turbine shaft to the synchronous speed of the line voltage or a subharmonic thereof. Typically, this is accomplished by detecting the speed of the turbine shaft 74 by a conventional speed pickup transducer 77. A signal 78 generated by transducer 77 is representative of the rotating shaft speed and is supplied to a conventional turbine controller 80. The controller 80 in turn governs the positioning of the steam admission valves using signal lines 82 for regulating the steam conducted through the turbine sections 66 and 70 in accordance with a desired speed demand and the measured speed signal 78 supplied to the turbine controller 80. The throttle valve 61 may be controlled at turbine start-up thus allowing the control valves 63 to be fully open until the turbine is initially operating at about five percent load. The system then transitions to partial-arc operation and the throttle valve 61 fully opened. However, the throttle valve 61 is generally an emergency valve used for emergency shut-down of the turbine. The line 65 from controller 80 provides control signals to valve 61.

A typical main breaker unit 84 is disposed between the electrical generator 76 and an electrical load 86 which for the purposes of the present description may be considered a bulk electrical transmission and distribution network. When the turbine controller 80 determines that a synchronization condition exists, the main breaker 84 may be closed to provide electrical energy to the electrical load 86. The actual power output of the plant may be measured by a conventional power measuring transducer 88, like a watt transducer, for example, which is coupled to the electrical power output lines supplying electrical energy to the load 86. A signal which is representative of the actual power output of the power plant is provided to the turbine controller 80 over signal line 90. Once synchronization has taken place, the controller 80 may conventionally regulate the steam admission valves 63 to provide steam to the turbine sections 66 and 70 commensurate with the desired electrical power generation of the power plant.

In accordance with the present invention, an optimum turbine efficiency controller 92 is disposed as part of the steam turbine power plant. The controller 92 monitors thermodynamic conditions of the plant at a desired power plant output by measuring various turbine parameters as will be more specifically described herebelow and with the benefit of this information governs the adjustment of the boiler steam pressure utilizing the signal line 94 coupled from the controller 92 to the boiler controller 64. In the present embodiment, the boiler pressure adjustment may be accomplished by altering the set point of a set point controller (not shown) which is generally known to be a part of the boiler controller 64. As may be the case in most set point controllers, the feedback measured parameter, like steam pressure, for example, is rendered substantially close to the set point, the deviation usually being a function of the output/input gain characteristics of the pressure set point controller. The controller 92 also supplies via line 46 to superheater 62 to control the final steam temperature.

Turbine parameters like throttle steam pressure and temperature are measured respectively by conventional pressure transducer 96 and temperature transducer 98. Signals 100 and 102 generated respectively by the transducers 96 and 98 may be provided to the optimum turbine efficiency controller 92. Another parameter, the turbine reheat steam temperature at the reheater 68 is measured by a conventional temperature transducer 104 which generates a signal on line 106 to the controller 92 for use thereby. The signal on line 90 which is generated by the power measuring transducer 88 may be additionally provided to the controller 92. Moreover, an important turbine parameter is one which reflects the steam flow through the turbine sections 66 and 70. For the purposes of the present embodiment, the steam pressure at the impulse chamber of the high pressure turbine section 68 is suitably chosen for that purpose. A conventional pressure transducer 108 is disposed at the impulse chamber section for generating and supplying a signal 110, which is representative of the steam pressure at the impulse chamber, to the controller 92.

One embodiment of the turbine efficiency controller 92 sufficient for describing the operation of the controller 92 in more specific detail is shown in U.S. Pat. No. 4,297,848 assigned to the assignee of the present invention, the disclosure of which is hereby incorporated by reference.

As described in the aforementioned U.S. Pat. No. 4,297,848, the controller 92 and the controller 80 may include microcomputer based systems for computing appropriate set points, e.g., throttle pressure and steam flow, for optimum operation of the steam turbine system in response to load demands. In the present invention, it is desirable to control throttle steam pressure applied to valves 63 in order to optimize system efficiency while having the ability to rapidly respond to increased load demand. The system of FIG. 5 achieves this result by controlling the boiler 54, primary superheater 58 and the finishing superheater 62 in a manner to regulate throttle steam pressure and temperature.

Figure 6:
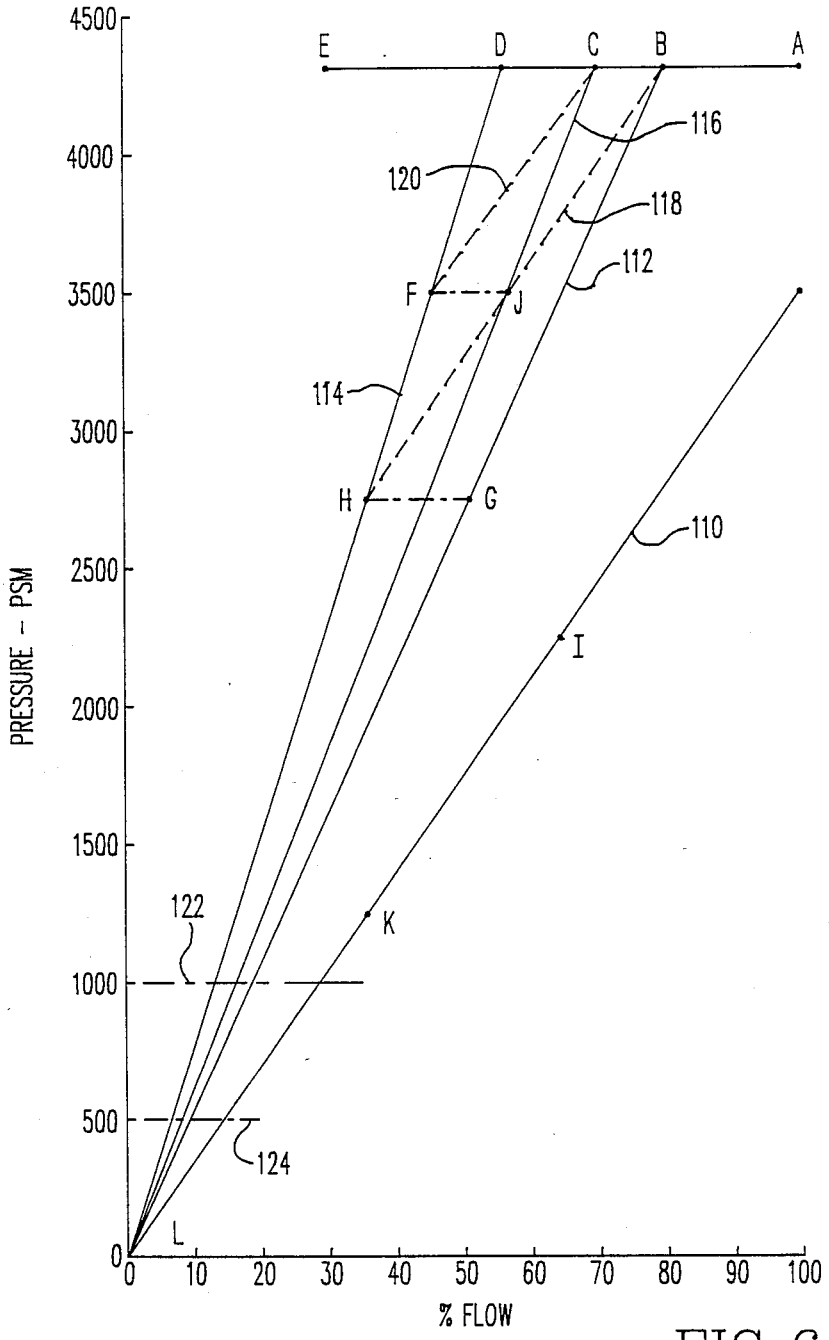
FIG. 6 is a chart illustrating a method of operating a steam turbine in accordance with one form of the present invention.

The method of operation of the system of FIG. 5 can best be understood by reference to FIG. 6 which illustrates a plurality of steam flow versus steam pressure diagrams for various partial-arc admissions of a high temperature, high pressure steam turbine. For purposes of discussion, it is assumed that the design of this turbine is such that the control stage blading is limited to 75% admission at full operating steam pressure, i.e., about 4300 psia. Line 110 represents the pressure drop across the control stage (nozzle inlet to impulse chamber). Line A, B, C, D, E represents full operating steam pressure. For example, the control stage pressure drop at full arc is about 850 psia, i.e., the difference between point 110A and 4300 psia. The maximum allowable pressure drop occurs at 75% admission and is about 1300 psia. Lines 122 and 124 bracket a typical minimum pressure area for most utility turbines, i.e., a pressure between 500 and 1000 psia. Using the method of the present invention in one form, control valves 63 are sequentially closed to reduce the arc of admission to 75% in response to load demands determined by controllers 80 and 92. At point B, representing 75% admission, the controllers hold admission constant while reducing throttle steam pressure along line 112 to point G. Pressure is then held constant and additional valves are closed to bring the turbine operating point to point H on the 50% admission line 114. The difference between the pressure at point H and the impulse chamber pressure at point K is essentially the same as between points B and 110A so that shock stresses at 50% admission are no greater than the design limit at 75% admission and should be lower because of the lower steam density.

If the turbine were designed to withstand shock loading at 62.5% admission at full pressure, the initial power reduction can be achieved by closing control valves 63 following line A, B, C, D to point C. Steam pressure can then be reduced along line 116 to point J. At that point, pressure is held constant and additional valves 63 are closed to reach point F. Further power reduction is achieved by reducing pressure along line F–L.

In another embodiment, the controllers 80, 92 are programmed to adjust steam pressure and close valves 63 concurrently so that turbine operation follows line 118 directly from point B to point H. Such operation may require alternate adjustment of pressure and valve closure so that line 118 appears more as a stair-step than a linear path. The same approach can be used to transition from point C to point F along line 120. In this embodiment, the differential pressure is maintained substantially constant, i.e. lines 110, 118 and 120 are substantially parallel. This method of operation is more efficient than the first disclosure method since it maintains the control stage at its designed pressure drop.

Figure 1:
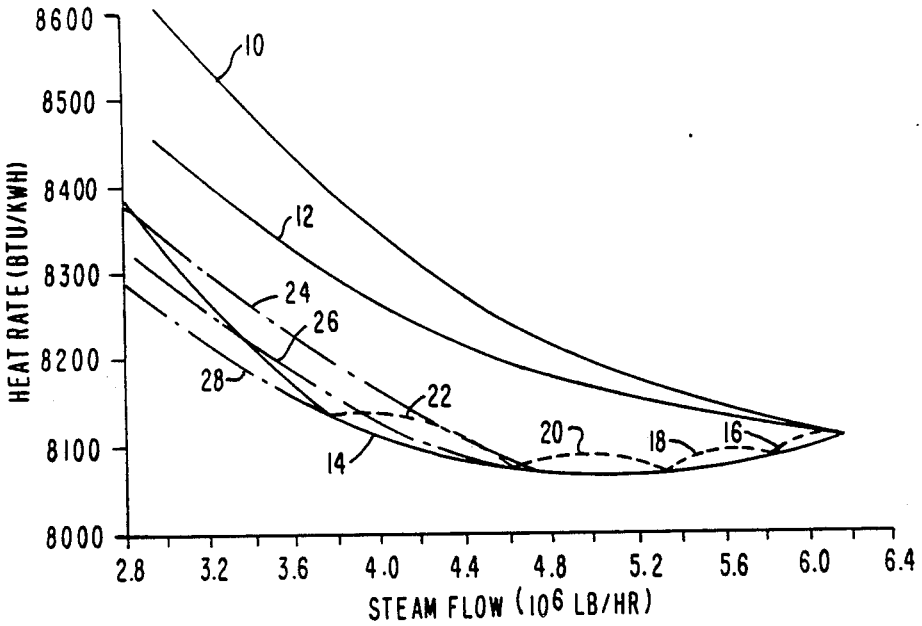
FIG. 1 is a sequence of steam flow versus heat rate curves characteristic of one prior art method of steam turbine control.
Figure 2:
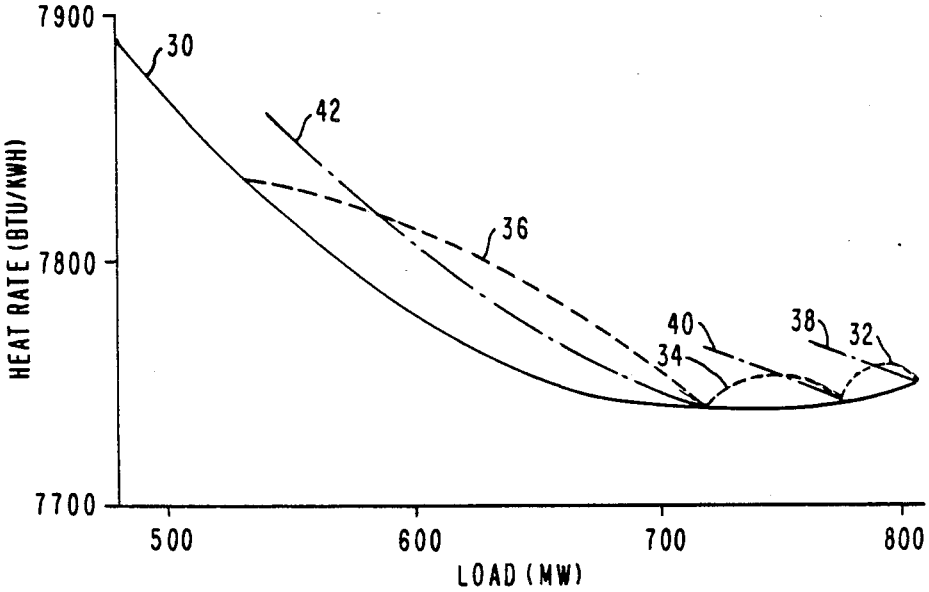
FIG. 2 is a curve charateristic of another prior art method of control of a steam turbine.
Figure 3:
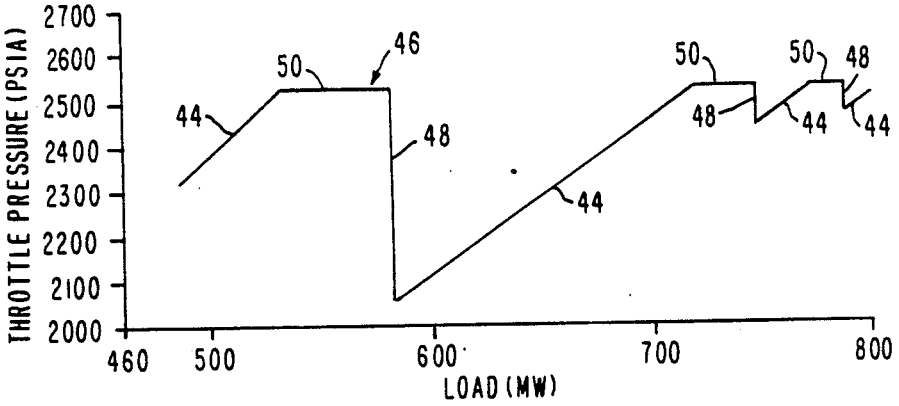
FIG. 3 illustrates throttle pressure as a function of load for the method of FIG. 2.
Figure 4:
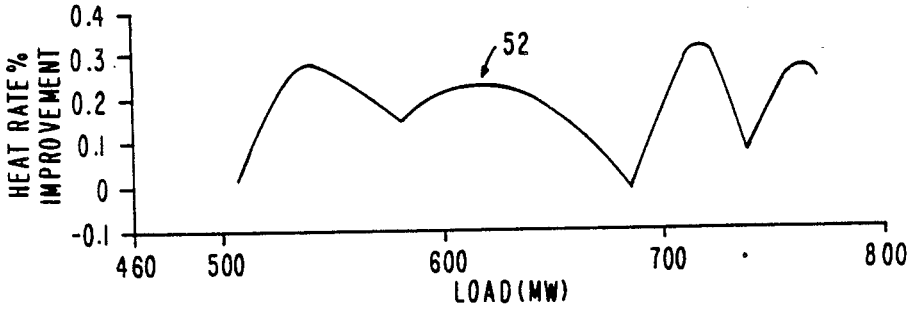
FIG. 4 illustrates calculated efficiency improvement for the method of FIG. 2.

In general, both of the above methods of operation follow the same pattern once 50% admission is reached, i.e., pressure is allowed to slide until a minimum pressure is reached, typically about 600–1000 psia on turbines operating at a design throttle pressure of 2400 psig. For loads requiring less than this minimum pressure at minimum design admission, throttling of the control valves is used to reduce power output. However, as was shown in FIG. 1, throttling produces a higher heat rate and is therefore less efficient. However, Applicant has found that even though such turbines are designed to operate at optimum at some set admission, e.g., 62.5% admission, additional improvement in heat rate can be attained by further reducing the arc of admission at low or minimum steam pressures. Table I illustrates a typical set of heat rates for an exemplary turbine operating at low loads and a minimum pressure of 600 psia. Note that there is a small improvement between 50% admission and 37.5% admission although there is no additional improvement in going to 25% admission. However, Table II illustrates than an improvement can be realized at 25% admission for a 2400 psig design throttle pressure turbine operating at a minimum throttle pressure of 1000 psia. Thus, this method of operation reduces heat rates when minimum throttle pressure is used and provides a benefit from operation at lower values of admission without detrimental effect on the control stage blading.

In summary, the present invention is disclosed as a method for reducing shock loading of control stage blading in a partial-arc steam turbine in which steam supply is controlled to match power demand. The turbine includes a plurality of control valves each arranged for admitting steam to a predetermined arc of admission at the control stage blading. The method comprises the steps of sequentially closing selected ones of the control valves to reduce the arc of admission to the minimum value permissible at full operating steam pressure; generally decreasing pressure to a valve such that the pressure drop across the first control stage at a selected further reduced arc of admission does not exceed the pressure drop at the minimum value of admission arc; closing additional selected ones of the control valves to reduce the arc of admission to the selected further reduced arc; and further decreasing steam pressure to maintain turbine power at the demand value. The method also includes the steps of gradually decreasing steam pressure and closing additional selected ones of the control valves, which are alternately repeated to reduce the arc of admission in a stepwise manner to an optimum value. The step of further reducing steam pressure is continued until steam pressure reaches a predetermined minimum value, and includes the further step of throttling the control valves to reduce turbine power when steam pressure is at the predetermined value. The step of closing additional selected ones of the control valves is continued until no additional improvement in heat rate is obtained.

By the present invention, there is disclosed a method for limiting pressure drop on control stage blading of a partial-arc steam turbine in which steam supply is controlled in order to match turbine power to power demand. The turbine uncludes a plurality of control valves each arranged for admitting steam to a selected arc of admission into the control stage blading. The method comprises the steps of sequentially closing predetermined ones of the control valves to reduce turbine power output by reducing the arc of admission to a first predetermined value; sliding steam pressure to a first reduced value to further reduce turbine power output while maintaining a constant arc of admission; sequentially closing additional ones of the control valves to further reduce the arc of admission to a second predetermined value and to reduce turbine output power toward demanded power while holding steam pressure at the first reduced value; and further sliding steam pressure to match turbine power to demanded power while holding the arc of admission at the second predetermined value.

While the principles of the invention have now been made clear in an illustrative embodiment, it will become apparent to those skilled in the art that many modifications of the structures, arrangements and components presented in the above illustrations may be made in the practice of the invention in order to develop alternate embodiments suitable to specific operating requirements without departing from the scope and principles of the invention as set forth in the claims which follow.

TABLE I

| | 600 Psia Pressure Heat Rate Comparison (BTU/KWH) | | | |
|---|---|---|---|---|
| % Load | 62.5% Adm. | 50% Adm. | 37.5% Adm. | 25% Adm. |
| 17 | 9654 | 9649 | 9649 | 9649 |
| 13.6 | 10089 | 9927 | 9927 | 9927 |
| 10.3 | 10781 | 10593 | 11492 | 10492 |
| 7.7 | 11675 | 11448 | 11238 | 11238 |

TABLE II

| | 1000 Psia Pressure Heat Rate Comparison (BTU/KWH) | | | |
|---|---|---|---|---|
| % Load | 62.5% Adm. | 50% Adm. | 37.5% Adm. | 25% Adm. |
| 30.2 | 8768 | 8763 | 8763 | 8763 |
| 29.8 | 8935 | 8874 | 8874 | 8873 |
| 23.5 | 9137 | 9010 | 9010 | 9010 |
| 20.1 | 9390 | 9252 | 9218 | 9218 |
| 16.8 | 9710 | 9563 | 9426 | 9426 |
| 13.5 | 10156 | 9993 | 9842 | 9834 |
| 10.2 | 10867 | 10678 | 10501 | 10336 |
| 7.6 | 11792 | 11563 | 11352 | 11154 |

What is claimed is:

1. A method for reducing shock loading of control stage blading in a partial-arc steam turbine in which steam supply is controlled to match power demand, the turbine including a plurality of control valves each arranged for admitting steam to a predetermined arc of admission at the control stage blading, the method comprising the steps of:

sequentially closing selected ones of the control valves to reduce the arc of admission to the minimum value permissible at full operating steam pressure;

generally decreasing pressure to a value such that the pressure drop across the first control stage at a selected further reduced arc of admission does not exceed the pressure drop at the minimum value of admission arc with designed throttle pressure;

closing additional selected ones of the control valves to reduce the arc of admission to the selected further reduced arc; and further decreasing steam pressure to maintain turbine power at the demand value.

2. The method of claim 1 wherein the steps of gradually decreasing steam pressure and closing additional selected ones of the control valves are alternately repeated to reduce the arc of admission in a stepwise manner to an optimum value.

3. The method of claim 1 wherein the step of further reducing steam pressure is continued until steam pressure reaches a predetermined minimum value, the method including the further step of throttling the control valves to reduce turbine power when steam pressure is at the predetermined value.

4. The method of claim 3 wherein the step of closing additional selected ones of the control valves at the minimum throttle pressure is continued until no additional improvement in heat rate is obtained.

5. A method for limiting pressure drop on control stage blading of a partial-arc steam turbine in which steam supply is controlled in order to match turbine power to power demand, the turbine including a plurality of control valves each arranged for admitting steam to a selected arc of admission into the control stage blading, the method comprising the steps of:

sequentially closing predetermined ones of the control valves to reduce turbine power output by reducing the arc of admission to a first predetermined value;

sliding steam pressure to a first reduced value to further reduce turbine power output while maintaining a constant arc of admission;

sequentially closing additional ones of the control valves to further reduce the arc of admission to a second predetermined value and to reduce turbine output power toward demanded power while holding steam pressure at the first reduced value; and further sliding steam pressure to match turbine power to demanded power while holding the arc of admission at the second predetermined value.

* * * * *